United States Patent [19]

Mulders et al.

[11] Patent Number: 4,508,471

[45] Date of Patent: Apr. 2, 1985

[54] METHOD AND MACHINE FOR THE LAYERED PLACING OF CORE MATERIAL AND OF THE ADJACENT TRANSITIONAL MATERIAL FOR DAMS

[75] Inventors: Gerardus L. M. Mulders, 'S-Hertogenbosch; Jacobus G. J. M. Hermans, Hedel, both of Netherlands

[73] Assignee: Bitumarin B.V., Netherlands

[21] Appl. No.: 360,084

[22] Filed: Mar. 19, 1982

[51] Int. Cl.[3] ..... E02B 7/02

[52] U.S. Cl. ..... 405/109; 405/116; 405/268

[58] Field of Search ..... 405/107, 109, 116, 117, 405/268; 264/33, 34; 425/59, 62, 64

[56] References Cited

U.S. PATENT DOCUMENTS 3,429,130 2/1969 Feiner et al. ..... 405/116
4,287,141 9/1981 Russell ..... 405/117 X

FOREIGN PATENT DOCUMENTS 2220687 11/1973 Fed. Rep. of Germany .
2221258 11/1973 Fed. Rep. of Germany .
2646592 12/1977 Fed. Rep. of Germany .

*Primary Examiner*—David H. Corbin
*Attorney, Agent, or Firm*—Jones, Tullar & Cooper

[57] ABSTRACT

Method for the layered placing of upright or sloping dam cores of material bound with bitumen and/or plastic and/or a natural binder in a constant or upward-tapering thickness for dams such as barrage dams characterized in that the core material is placed from a silo of a travelling machine; that at the same time transitional material is placed, from one or more silos of that machine, alongside and against the placed core material; that the dam core is formed with the aid of a sliding formwork located on the machine to give lateral support to the core until and while the transitional material is placed; that the core material, immediately after it has been placed and before the transitional material is placed, is pre-compacted both vertically and laterally; and that subsequently the core material and the transitional material are (further) compacted.

6 Claims, 3 Drawing Figures

METHOD AND MACHINE FOR THE LAYERED PLACING OF CORE MATERIAL AND OF THE ADJACENT TRANSITIONAL MATERIAL FOR DAMS

The invention relates to a method and machine for the layered placing of upright or sloping dam cores of material bound with bitumen and/or plastic and/or a natural binder in a constant or upward-tapering thickness for dams such as barrage dams.

The method can be employed, for example, for barrage dams with or without transitional zone, consisting of finely-grained filter material.

PRIOR ART

Various methods are currently known for placing dam cores. One technique involves the use of formwork moulds or walls within or inbetween which the core material is dumped. The formwork is removed as soon as the transitional material bordering the core has been placed up to the top edge of the core. Subsequently core material and transitional material are compacted, either simultaneously or at different times.

This method is time-consuming because of the discontinuous nature of the operation, both in the horizontal and in the vertical direction. Furthermore, no clear-cut separation is achieved between the core material and the adjacent transitional material.

One method developed in the past, whereby both the core material and the transitional material are placed simultaneously but are physically separated by walls, brought some improvement. The drawback of this method, however, is that compaction is not effected until the wall separating core material and transitional material has disappeared, so that during compaction the transitional material is forced sideways into the core material. Although this brings about a certain degree of interpenetration between core material and transitional material, it does have the drawback that the zone where core material and transitional material interpenetrate is less compact and will exhibit cracks or fissures, with the result that the effective width of the watertight core is diminished.

Systems subsequently employed, whereby the core material, after being pre-compacted, stands free until the transitional material is placed against the core material, have the drawback that contamination of the core surface occurs during placing of the transitional material; furthermore, damaging of the free-standing core is possible.

SUMMARY OF THE INVENTION

The invention envisages an improved method and machine for the placing of dam cores and relates to the method for the layered placing of upright or sloped dam cores of material bound with bitumen and/or plastic and/or a natural binder in a constant or upward-tapering thickness for dams such as barrage dams . It is characterized in that the core material is placed from a silo of a travelling machine; that at the same time transitional material is placed, from one or more silos of that machine, alongside and against the placed core material; that the dam core is formed with the aid of a sliding formwork located on the machine to give lateral support to the core until and while the transitional material is placed; that the core material, immediately after it has been placed and before the transitional material is placed, is pre-compacted both vertically and laterally; and that subsequently the core material and the transitional material are (further) compacted.

The machine preferably travels over the already compacted transitional material of an underlying layer.

Pre-compaction of the core material can be effected by means of vibrating plates located on or in the formwork.

The method is preferably executed in such a way that the transitional material is driven by means of a conveying worm in the direction of the core material, while a second worm removes excess material and while the top of the core is protected by a covering plate.

It is also preferable to effect the re-compaction of the core material and the compaction of the transitional material simultaneously behind the sliding formwork by means of vibrating plates located at the rear of the machine.

If, for example, a bituminous binder is used, the core material is preferably placed after the underlying layer of the core material has been heated by means of, for example, infra-red radiators.

By adjustment of the sliding formwork, the height, breadth and form of the dam core can be varied.

The invention likewise relates to a machine for executing the present method, characterized in that it is provided with travelling elements such as caterpillar treads, a silo for core material, one or more silos for transitional material and a sliding formwork for forming the dam core.

Vibrators are preferably located on or in the formwork for both vertical and lateral pre-compaction of the dam core.

At the rear, conveying worms for driving and removing the transitional material can be located.

A covering plate is preferably provided to protect the top of the dam core during the placing of the transitional material.

Moreover, infra-red radiators may be present at the front and vibrating plates at the rear. The height, breadth and form of the sliding formwork can be varied.

By means of the described method, the transitional material remains separated from the core material by the sliding formwork while the covering plate on top of the newly-laid core prevents the transitional material from contaminating the core material.

An embodiment of the invention is described in further detail below with the aid of the drawings.

DETAILED DESCRIPTION

Figure 1:
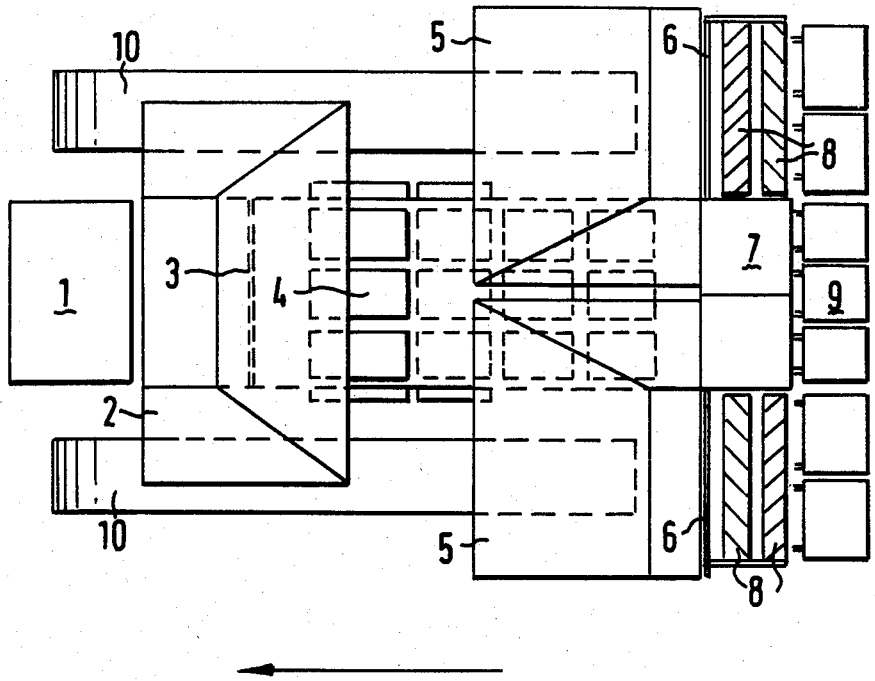
FIG. 1 represents a top view of the machine.
Figure 2:
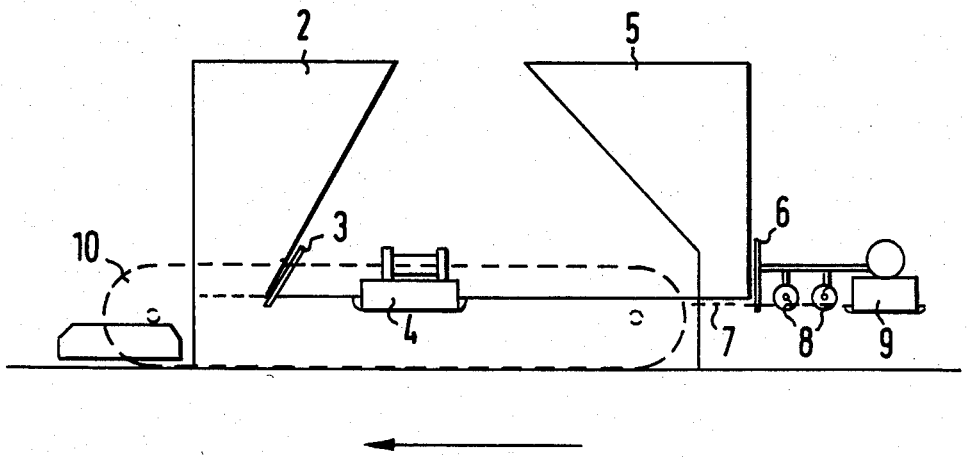
FIG. 2 is a longitudinal section of the machine.
Figure 3:
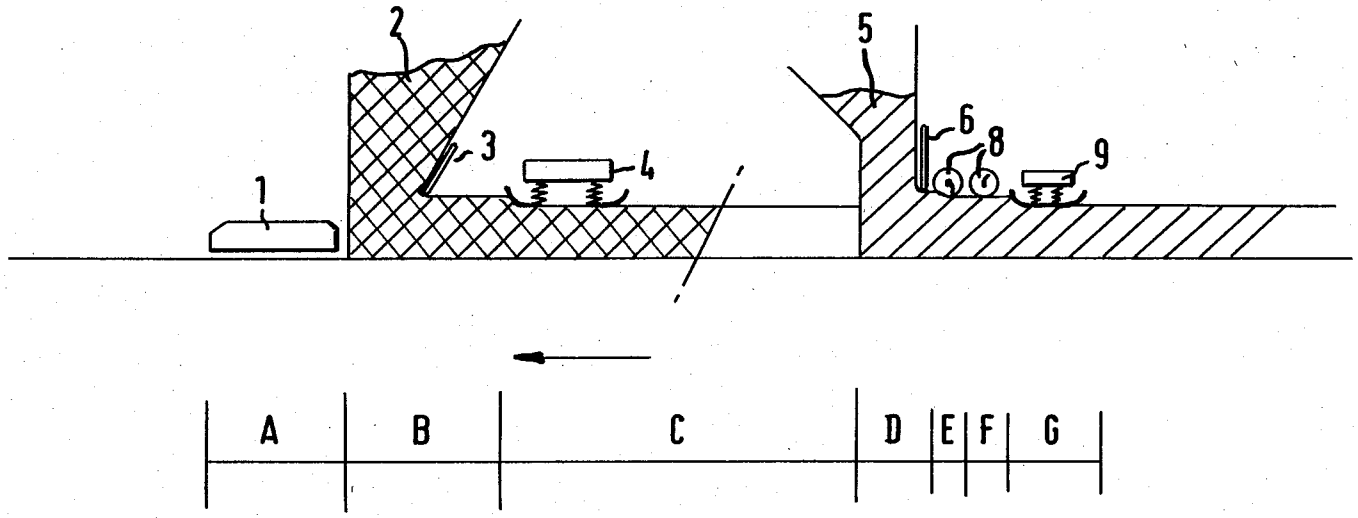
FIG. 3 is a layout sketch of the dam core.

In the figures, the arrow indicates the direction of travel of the machine. Furthermore, the following nomenclature applies in the figures:

1 Infra-red burners
2 Core material silo
3 Core height control effected by means of a strike-off bar, which is controlled for example with the aid of a laser beam
4 Pre-compactor (vibrating plates)
5 Transitional material silos
Transitional material height control effected by means of two strike-off bars
7 Core covering plate and lateral guide plate 8 Filling and levelling screw (controllable)
9 Vibrating plates
10 Travelling caterpillars Moreover, FIG. 3 shows the following zones:

A Preheating of already laid core
B Placing of core
C Pre-compaction of core (in lateral direction as well)
D Placing of transitional material
E Filling of transitional material against core wall
F Levelling of core material
G Compaction of core and transitional material One advantage of the present method is that the core material is situated in a protective tunnel until and while the transitional material is placed. The start of this tunnel is joined up to the outlet of the silo 2 whence the core material is dosed and which is provided with a vertically adjustable strike-off bar 3 to control the height of the layer to be placed.

In the case of bituminous core consolidation, the surface of the underlying core layer is heated by infrared radiators 1 in order to ensure optimum adhesion between the successive layers.

Immediately downstream of the outlet of the silo, the tunnel is provided with vibrating plates 4 (compactors), both on the sidewalls and on the top. The advantage of lateral compaction in conjunction with vertical compaction is that the core material is endowed with optimum properties in terms of watertightness in that direction in which the core is subjected to the severest loads (horizontal water pressures) under ultimate conditions of use. Depending upon the consistency of the core material, the number of compactors in the longitudinal direction of the tunnel can be increased.

In the longitudinal direction, the tunnel can consist of several segments hinge-connected to one another. This makes it possible to construct a horizontally-curved core should the geometry of the barrage dam so require.

The transitional material is dosed from two silos 5. The height of the placed transitional material is in the first instance controlled by two strike-off bars 6 which are adjustable in height. This setting can be effected independently for either strike-off bar, thereby permitting layers of transitional material with differing thicknesses to be placed on either side of the core material. As the entire machine travels, with the aid of, caterpillar treads 10, on the compacted transitional material of the previously placed layer, it is thereby possible to tilt the machine and thus construct a sloping core.

After the height of the transitional material has been controlled by the bars 6, two worm screws 8 on either side of the core ensure that the transitional material is levelled by means of a movement towards the core while a second pair of worm screws removes any excess transitional material. A plate 7 on the top of the core ensures that the core material remains free of contamination.

Subsequently, vibrating plates 9 ensure that the transitional material is compacted and that the core material is finally compacted.

The entire machine moves on caterpillar treads over the compacted transitional material of the previously placed layer. This layer forms a sufficiently level driving surface for the equipment in order to place a layer of core material having a thickness lying within acceptable tolerances.

At the same time, the thickness of the layer is controlled by the strike-off bar 3, which can receive its signals from a laser beam.

In the longitudinal direction, positioning is effected, for example, by sighting a paint line on the underlying layer of core material by means of a sighting device. This paint line can be made by a device located in the axis of the tunnel underneath plate 7.

To vary the width of the core, the tunnel with compaction vibrators can be interchanged.

We claim:

1. A method for the layered placing of upright or sloping dam cores for dams such as barrage dams, wherein the core material is bound with bitumen and/or plastic and/or a natural binder in a constant or upward-tapering thickness, comprising the steps of:

placing the core material and compacting the placed core material both vertically and laterally to effect pre-compaction of the core material;

placing transitional material against each lateral side of the placed and compacted core material; and further compacting the core material and simultaneously compacting the transitional material.

2. The method as defined in claim 1, further comprising the steps of:

driving the placed but uncompacted transitional material toward the placed core material; and covering the top of the placed core material.

3. The method as defined in claim 1, wherein the dam core is formed with the aid of a sliding formwork, and wherein the method further comprises the step of:

varying the height, breadth and form of the dam core by adjustment of the sliding formwork.

4. A machine for the layered placing of upright or sloping dam cores for dams such as barrage dams, wherein the core material is bound with bitumen and/or plastic and/or a natural binder in a constant or upward-tapering thickness, comprising:

a sliding formwork to form the dam core;

travel means for moving the machine while placing the dam core;

core material supply means from which core material is placed in the sliding formwork;

at least one transitional material supply means from which transitional material is placed alongside and against a lateral side of the placed core material;

vibration means situated between the core material supply means and the transitional material supply means for compacting the placed core material both vertically and laterally to thereby effect pre-compaction of the core material; and further vibration means situated upstream, relative to the direction of travel of the machine, of the transitional material supply means for further compacting the core material and simultaneously compacting the transitional material.

5. The machine as defined in claim 4, further comprising:

cover means for protecting the placed core material during the placing of the transitional material.

6. The machine as defined in claim 4, wherein the sliding formwork is adapted to be varied in height, breadth and form.

* * * * *